United States Patent [19]

McCulloch et al.

[11] 3,986,910

[45] Oct. 19, 1976

[54] COMPOSITE PROPELLANTS CONTAINING CRITICAL PRESSURE INCREASING ADDITIVES

[75] Inventors: Charles R. McCulloch; Bertram K. Moy, both of Shalimar, Fla.

[73] Assignee: The United States of America as represented by the Secretary of the Navy, Washington, D.C.

[22] Filed: Apr. 12, 1974

[21] Appl. No.: 460,392

[52] U.S. Cl. ..... 149/19.9; 149/18; 149/19.1; 149/19.92; 149/20

[51] Int. Cl.[2] ..... C06B 45/10

[58] Field of Search ..... 149/19.9, 19.91, 20, 149/21, 18, 19.1, 19.92

[56] References Cited

UNITED STATES PATENTS

| | | | |
|---|---|---|---|
| 3,359,350 | 12/1967 | Godfrey | 264/3 R |
| 3,392,068 | 7/1968 | Knowles et al. | 149/21 |
| 3,476,622 | 11/1969 | Harada et al. | 149/19.9 X |
| 3,520,742 | 7/1970 | Witz | 149/19.3 X |
| 3,577,289 | 5/1971 | Morrell | 149/19.91 X |
| 3,682,727 | 8/1972 | Heinzelmann et al. | 149/19.91 X |
| 3,822,154 | 7/1974 | Lawrence et al. | 149/19.1 |

*Primary Examiner*—Edward A. Miller
*Attorney, Agent, or Firm*—R. S. Sciascia; A. L. Branning; P. J. Hagan

[57] ABSTRACT

Increasing the critical pressure of composite propellants by admixing into the propellant composition an additive selected from the group consisting of (1) oxides of Group II metals, titanium, aluminum, boron, zirconium, and lead; (2) nitrides of Group II metals, aluminum, and boron; (3) carboxylates, formates, and sulfates of Group II metals, aluminum, calcium, and magnesium; (4) hydrates of the carboxylates, formates, and sulfates of Group II metals, aluminum, calcium, and magnesium; (5) the following fibrous materials, asbestos, quartz, carbon, and boron; (6) the following metal: Group II metals and boron; and (7) mixtures thereof.

4 Claims, No Drawings

COMPOSITE PROPELLANTS CONTAINING CRITICAL PRESSURE INCREASING ADDITIVES

BACKGROUND OF THE INVENTION

This invention relates to composite solid propellants and in particular to composite propellants for rocket catapult motors.

Composite solid propellants are mixtures of a finely ground oxidizer and a solid fuel dispersed in a matrix of plastic, resinous, or elastastomeric material. These propellants can also contain other compounding ingredients in order to change the ballistic or physical properties of the propellant.

The correlation between the burning rate and the combustion chamber pressure is commonly expressed as $r=Kp^n$ or $\log r=n \log P + \log K$ where $r$ is the burning rate in inches per second; P is the combustion chamber pressure in pounds per square inch; K is a constant which varies with the ambient grain temperature, and $n$ is a constant known as the burning rate exponent. Ideally a plot of log $r$ against log P would give a straight line with a slope of $n$ for a non-modified propellant.

From frequent usage, the value of the burning rate exponent have become an accepted measure of the pressure sensitivity of a propellant. The sensitivity of the burning rate to changes in the comubstion chamber pressure decreases as the value of $n$ approaches zero. In compounding a propellant, it is extremely important that the value of $n$ be kept as low as possible. If $n$ exceeds 0.95, the combustion reaction becomes uncontrolled and the combustion chamber explodes. Values of $n$ between 0.75 and 0.95 require great care in selecting the charge geometry and nozzle design. Even with those precautions, there is little likelihood that the combustion reaction would be controllable because unfortunately the burning rate exponent does not remain constant. If the burning rate exponent stays below 0.75, the burning is managable. Thus, any increase in $n$ simply causes the pressure and the burning rate to increase.

At some pressure, composite propellants will experience a large and sudden increase in the burning rate exponent over a small increment in pressure. For example the exponential will jump from 0.5 to 0.9 with a small increase in pressure. The pressure at which the burning rate exponent begins to change radically is termed the critical pressure.

The value of this pressure is of paramount importance in compounding high thrust propellants. It is often considered the chief limitation of this type of propellant because if the burning rate remains insensitive to combustion chamber pressure at higher pressures, there is greater latitude in choosing the charge geometry or the nozzle design. In military applications, this is further compounded by the requirement that the propellant have a consistant performance over an ambient temperature range of −65° F to + 165° F. As the ambient temperature increases, the burning rate, the combustion chamber pressure, and the burning rate exponent increases.

SUMMARY OF THE INVENTION

Accordingly an object of this invention is to provide a more versatile composite propellant.

Another object of this invention is to increase the safety of catapult rockets.

Another object of this invention is to decrease the chamber pressure sensitivity of composite propellants.

And another object of this invention is to shift the critical pressure of composite propellants as high as 7500 psi.

These and other objects are achieved by incorporating into the composite propellant small amounts of ingredients which have a high heat capacity and a high thermal stability, so that, the critical pressure of a composite propellant formulation is increased.

DESCRIPTION OF THE PREFERRED EMBODIMENTS

It is not completely understood why the disclosed ingredients of this invention are so remarkably effective in increasing the critical pressure. The high heat capacity and high thermal stability of the ingredients indicate that particles of the ingredients act as heat sinks in the fizz and foam zones of the propellant's combustion. The increased effectiveness of the fibrous materials indicate that these materials also help prevent gross ablation of the burning surface of the propellant. A large number of ingredients have this capability of shifting the critical pressure higher in composite propellants.

Certain oxides of metals can do this. It has been determined that beryllium oxide, magnesium oxide, calcium oxide, strontium oxide, barium oxide, radium oxide, zinc oxide, cadmium oxide, mercuric oxide, aluminum oxide, titanium dioxide, boron oxide, zirconium oxide, and lead oxide. For convenience these oxides have been summarized as follows: oxides of Group IIA metals, zinc, cadmium, mercury, aluminum, titanium, boron, zirconium, and lead.

A number of nitrides are similarly useful. They are beryllium nitride, magnesium nitride, calcium nitride, strontium nitride, barium nitride, radium nitride, zinc nitride, cadmium nitride, mercuric nitride, aluminum nitride, and boron nitride. These can be summarized as follows: nitrides of Group $II_A$ metals, zinc, cadmium, mercury, aluminum, and boron.

Certain carboxylates can also shift the critical pressure. It has been determined that beryllium carboxylate, magnesium carboxylate, calcium carboxylate, strontium carboxylate, barium carboxylite, radium carboxylate, zinc carboxylate, cadmium carboxylate, mercuric carboxylate, aluminum carboxylate, calcium carboxylate, and magnesium carboxylate. They can be criptically referred to as carboxylates of Group $II_A$ metals, zinc, cadmium, mercury, aluminum, calcium, and magnesium.

Formates of certain metals are also capable of shifting the critical pressure. These are beryllium formate, magnesium formate, calcium formate, strontium formate, barium formate, radium formate, zinc formate, cadmium formate, mercuric formate, aluminum formate, calcium formate, and magnesium formate. These formates may be referred to as formates of Group $II_A$ metals, zinc, cadmium, mercury, aluminum, calcium, and magnesium.

Sulfates which can achieve a higher critical pressure in composite propellants are beryllium sulfate, magnesium sulfate, calcium sulfate, strontium sulfate, barium sulfate, radium sulfate, zinc sulfate, cadmium sulfate, mercuric sulfate, aluminum sulfate, calcium sulfate, and magnesium sulfate. These also may be summarized as sulfates of Group $II_A$ metals, zinc, cadmium, mercury, aluminum, calcium, and magnesium.

The hydrates of the aforementioned carboxylates, formates, and sulfates are also capable of increasing the critical pressure. Certain fibrous materials are similarly useful. They are asbestos, quartz, carbon, and boron. The fiber size may be up to 600$\mu$ in length and up to 2$\mu$ in diameter, but preferably the fiber size is not greater than 2$\mu$ in length and 2$\mu$ in diameter. Metals within the scope of this invention are beryllium, magnesium, calcium, strontium, barium, radium, zinc, cadmium, mercury, and boron. In this application these metals are referred to as Group II metals and boron. Of course mixtures of any of the previously mentioned oxides, salts, hydrates, fibrous materials, and metals can be used in accordance with this invention. Of the aforementioned metals, cadmium, mercury, titanium, boron, zirconium, and lead have multiple valences; however, only one of the valences is desired. The particular valence for each of the metals with multiple valences is +2 for cadmium, +2 for mercury, +4 for titanium, +3 for boron, +4 for zirconium, and +4 for lead. Hereinafter the preferred valence is written in parenthesis by the metal in order to specify the particular oxide or salt.

Like the fibrous materials, the effectiveness of the particulate materials is increased by a reduction in size. Reducing the particles size also improves the strength of the propellant. For these reasons the particle size of the additives of this invention should not exceed about 15$\mu$ and it is preferred to use as small a particle size as possible.

The amount of the additives within the scope of this invention is from about 0.3 to about 3.5 weight percent except for the fibrous material which cause casting problems with the propellant if used in amount greater than about 2 weight percent. The preferred amount for the nonfibrous ingredients is from 2.5 to 3.0 weight percent. For the fibrous ingredients, the preferred amounts is from 1.5 to 2.0 weight percent.

One or more of the additives of this invention is admixed thoroughly with the usual composite propellant ingredients of fuel, oxidizer, binder, and other additional modifying ingredients. Since these additives are inert with the commonly used ingredients, no new problem is created by the inclusion of these additives.

Suitable fuels include aluminum, zirconium, and mixtures and alloys of these with one another and/or with other elements. The preferred fuel is aluminum having a particle size of no more than 50$\mu$. From about 10 to about 25 weight percent may be used, but the preferred amount is from 12 weight percent to 15 weight percent.

Examples of suitable oxidizers include potassium perchlorate, ammonium perchlorate, ammonium nitrate, and mixtures thereof. The preferred oxidizer is ammonium perchlorate. Particle size of this oxidizer should not be more than about 250$\mu$. Preferably a mixture of an approximately 12$\mu$ particle size and a coarse particle size (150–250$\mu$) in about a 2:1 fine to coarse ratio is to be used. The combination of coarse and fine particles aids in the control of mix viscosity and has an influence on the burning rate of the propellant. The amount of oxidizer to be used is from about 65 to about 90 weight percent with a preferred amount from 70 to 80 weight percent.

The binder in accordance with this invention may be 1, 2 or 1, 4 hydroxy or carboxy terminated polybutadiene, polyisoprene, 2,3 dimethyl-1,3-butadiene, copolymers of these open chain conjugated dienes with a vinyl heterocyclic nitrogen compounds, i.e., monovinylpyridine, mixtures thereof, and the like. Molecular weight of the binder is from 4,000 to 10,000. The upper limit on the molecular weight of the binder is dictated by processing considerations. Preferably the binder is 1,4 carboxyterminated polybutadiene (CTPB) with a molecular weight of 4000 to 10,000 in an amount from about 10 to about 20 weight percent. The preferred amount is from 12 to 17 weight percent of the total composition.

The other ingredients which are generally added to impart modifications to the basic composition include burning rate catalysts, plasticizers, antioxidants, wetting agents, and curing agents. Examples of suitable burning rate catalysts are ammonium dichromate, copper chromate, ferric oxide, and mixtures thereof. An amount up to about 8 weight percent may be incorporated in the composite propellants of this invention. Preferably ferric oxide is added in an amount from 3 to 5 weight percent of the total composition.

Representative plasticizers include dioctylsebacate, isododecyl pelargonate and mixtures thereof. Plasticizers constitute from about 20 to about 45 weight percent with a preferred range of 20 to 30 weight percent of the total propellant composition.

The preferred antioxidant is 2,4,6 triisopropylphenol. The amount to be incorporated is from about 0.5 to about 1 weight percent with 1 weight percent the preferred amount. Suitable curing agents are trismethylaziridinyl phosphine oxide (MAPO), 4,4′-diphenolmethaneglycidylether (DPMG), and mixtures thereof. The preferred curing agent is 50–50 mixture of these two curing agents in an amount from about 0.2 to about 0.4 weight percent with 0.25 to 0.30 weight percent preferred.

Composite propellant compositions within the scope of this invention may be prepared by any of the commonly used methods of preparation for composite propellants. The following method is given as an example. It is also the method used to prepare the specific examples of this application.

The liquid and solid phases are blended in a mixer for 1 hour. Air trapped in the mixer is removed by a vacuum of 15mm Hg to produce a denser batch and to prevent voids in the casting. The propellant is then cured at 170° F for 72 hours.

The general nature of the invention having been set forth, the following examples are presented as specific illustrations thereof.

TABLE I

| | COMPOSTION (WEIGHT PERCENT) | | | | | |
|---|---|---|---|---|---|---|
| Component | Ex. 1 | Ex. 2 | Ex. 3 | Ex. 4 | Ex. 5 | Ex. 6 |
| Ap (12$\mu$) | 54.95 | 54.95 | 54.95 | 54.95 | 54.95 | 54.95 |
| Ap (200$\mu$) | 23.55 | 23.55 | 23.55 | 23.55 | 23.55 | 23.55 |
| Al | 1.50 | 1.50 | 1.50 | 1.50 | 1.50 | 1.50 |
| $Fe_2O_3$ | 3.00 | 3.00 | 3.00 | 3.00 | 3.00 | 3.00 |
| CTPBD | 15.42 | 15.42 | 14.46 | 15.42 | 15.42 | 15.42 |
| MAPO | 0.29 | 0.29 | 0.27 | 0.29 | 0.29 | 0.29 |
| DPMG | 0.29 | 0.29 | 0.27 | 0.29 | 0.29 | 0.29 |
| $TiO_2$ | — | 1.00 | 2.00 | — | — | — |
| Asbestos Fiber | — | — | — | 1.00 | — | — |
| Fine Asbestos Fiber | — | — | — | — | 1.00 | — |
| $B_2O_3$ | — | — | — | — | — | 1.00 |
| Crit. Pressure (psi) | 4500 | 6000 | 7000 | 7000 | 7500 | 6000 |

The examples in TABLE I were tested by means of a Crawford Bomb. A strand of propellant about 4 to 5 inches long was placed in the Bomb's test chamber. The chamber was pressured by nitrogen gas to a particular pressure which may be as high as 10,000 psi. The propellant was then ignited. Recordings were made of time and length of strand. From this data and a log-log of burning rate v. pressure, the critical pressure was determined.

The data in Table I indicates that (1) the critical pressure can be displaced from 4500 to 7500 psi; (2) the best efficiency of displacement, at the 1% level is fine fiber asbestos; and (3) that an increase in the additive level produces a further displacement of the critical pressure. This displacement of the critical pressure caused by the addition of the aforementioned additives makes possible for motor performance requirements to be reliably obtained over the 160° to −65° F temperature range.

Obviously many modifications and variations of the present invention are possible in light of the above teachings. It is therefore to be understood that, within the scope of the appended claims, the invention may be practiced otherwise than as specifically described.

The weight percentages of the components of the composition in the specification and claims are by weight of the entire composition.

What is claimed as new and desired to be secured by Letters Patent of the United States is:

1. A composite propellant characterized by stable burning at high combustion chamber pressures which comprises a binder, a metal fuel, an oxidizer, and asbestos fiber in an amount from 1.5 to 2.0 percent by weight of the composition as a critical pressure increasing additive.

2. The composition of claim 1 wherein the binder is carboxy-terminated polybutadiene which comprises from about 10 to about 20 percent by weight of the composition, the fuel is aluminum, which comprises from about 10 to about 25 percent by weight of the composition, and the oxidizer is ammonium perchlorate, which comprises from about 65 to about 90 percent by weight of the composition.

3. A method for increasing the critical pressure of a composite propellant composition which comprises adding to the composition asbestos fiber in an amount from 1.5 to 2.0 percent by weight of the composition.

4. A method for increasing the critical pressure of a composite propellant composition which comprises adding to the composition an additive selected from the group consisting of titanium dioxide and boron oxide in an amount from 2.5 to 3.0 percent by weight of the composition.

* * * * *